US005196892A

United States Patent [19]

Mitsuaki

[11] Patent Number: 5,196,892

[45] Date of Patent: Mar. 23, 1993

[54] IMAGE FORMING APPARATUS HAVING A DISORDERING AND CHARGING DEVICE FOR DISORDERING A DEVELOPING AGENT REMAINING ON AN IMAGE BEARING MEMBER AND FOR CHARGING THE IMAGE BEARING MEMBER

[75] Inventor: Kohyama Mitsuaki, Tokyo, Japan

[73] Assignee: Kabushiki Kaisha Toshiba, Japan

[21] Appl. No.: 896,991

[22] Filed: Jun. 11, 1992

[30] Foreign Application Priority Data

Jun. 28, 1991 [JP] Japan ..... 3-158597

[51] Int. Cl.[5] ..... G03G 15/06

[52] U.S. Cl. ..... 355/269; 355/219; 355/270; 355/296

[58] Field of Search ..... 355/219, 269, 270, 301, 355/296–298, 303

[56] References Cited

U.S. PATENT DOCUMENTS

| | | | |
|---|---|---|---|
| 3,617,123 | 11/1971 | Emerson | 355/270 X |
| 4,387,980 | 6/1983 | Ueno et al. | 355/219 |
| 4,469,435 | 9/1984 | Nosaki et al. | 355/303 |
| 4,769,676 | 9/1988 | Mukai et al. | 355/269 |
| 5,055,882 | 10/1991 | Fushimi | 355/269 |
| 5,066,982 | 11/1991 | Hosoya et al. | 355/269 |
| 5,119,138 | 6/1992 | Oda et al. | 355/269 |
| 5,122,838 | 6/1992 | Kohyama | 355/269 |

FOREIGN PATENT DOCUMENTS 0138844 1/1991 Japan .

*Primary Examiner*—A. T. Grimley
*Assistant Examiner*—William J. Royer
*Attorney, Agent, or Firm*—Banner, Birch, McKie & Beckett

[57] ABSTRACT

An image forming apparatus has a developing and cleaning device for developing a latent image formed on an image bearing member with a developing agent and for simultaneously removing the developing agent remaining on the image bearing member, a transfer device for transferring the developed image on the image bearing member to a recording medium and a disordering and charging device for disordering any developing agent remaining on the image bearing member after transfer of the developed image by the transfer device and for simultaneously charging the image bearing member. The disordering and charging device has a first disordering and charging member for disordering the residual developing agent and for charging the surface of the image bearing member at a first charge potential and a second disordering and charging member for disordering the developing agent disordered by the first disordering and charging member and for charging the surface of the image bearing member at a second charge potential. Thereby, the disordering and charging device of the present invention can uniformly charge the entire surface of the image bearing member and sufficiently disorder any residual developing agent remaining on the image bearing member.

14 Claims, 4 Drawing Sheets

IMAGE FORMING APPARATUS HAVING A DISORDERING AND CHARGING DEVICE FOR DISORDERING A DEVELOPING AGENT REMAINING ON AN IMAGE BEARING MEMBER AND FOR CHARGING THE IMAGE BEARING MEMBER

BACKGROUND OF THE INVENTION

1. Field of the Invention

This invention relates to an image forming apparatus, such as an electrophotographic printer, for forming an image on an image bearing member and, more particularly, to an image forming apparatus having a disordering and charging device for disordering a developing agent remaining on the image bearing member and for uniformly charging the image bearing member.

2. Description of Related Information

Generally, in conventional image forming apparatus, a surface of an image bearing member, such as a photosensitive drum, is charged by a main charger. The entire surface of the drum is charged by the main charger. Then, a latent image is formed on the image bearing member. A developing device then develops the latent image using a developing agent (toner) to make the latent image visible. Subsequently, the developed image is transferred onto a medium such as a paper sheet by a transferring device. Most of the toner of the developed image on the image bearing member is transferred onto the paper sheet by the transferring device during the image transfer process. However, some portion of the toner of the developed image remains on the image bearing member after the transfer of the developed image to the paper sheet by the transferring device. Thus, the residual toner particles on the image bearing member are typically removed from the image bearing member by a cleaning device.

Recently, in the art of image forming apparatus development there has been recognized a need to reduce the size of the apparatus into a more compact housing. For example, to this end, U.S. Pat. No. 4,769,676 discloses an image forming apparatus having a device which simultaneously performs the developing process and the cleaning process. The image forming cycle of the apparatus is performed within one rotation of its image bearing member. Thus, use of this developing and cleaning device has reduced the size of the image forming apparatus since an image bearing member can be used that has a reduced diameter. The disclosed device, which serves as both a developing device and a cleaning device, does not require, for example, as much of the circumference of the drum which forms the image bearing member.

Further, this image forming apparatus includes a disordering device positioned before a main charger. This disordering device disorders the residual toner image remaining on the image bearing member after the transfer of the developed image to a medium and before the next image forming operation. The disordering device includes a conductive member (a conductive roller or a conductive brush) which is in sliding contact with the image bearing member. The conductive member has applied to it a bias voltage. Therefore, by sliding contact between the conductive member and the image bearing member, the residual toner is temporarily attracted to the conductive member and is then deposited over other parts of the surface of the image bearing member. Thereby, the residual toner is disordered. Any residual toner image is made non-patterned and loses its original appearance.

Moreover, furthering an objective of the present invention to reduce the size of image forming apparatus into a more compact housing, there are related applications of the same inventor (U.S. applications Ser. No. 531,245 filed May 31, 1990 and Ser. No. 694,761 filed in May 2, 1991). These disclose a disordering and charging device which performs both the functions of charging and disordering in a single conductive member. Thus, in this disordering and charging device, comprising a single conductive member, the need for a separate main charger as shown in U.S. Pat. No. 4,769,676 is eliminated.

However, in the disordering and charging device according to these disclosures, since both the function of charging and disordering is performed by the single conductive member, it is very difficult to sufficiently disorder the residual toner image and to uniformly charge the surface of the image bearing member. Thus, a residual toner image can still remain in the next image forming process. Consequently, the next image forming cycle may be carried out so that the new image to be transferred is superimposed on the residual toner image remaining on the image bearing member. Furthermore, the surface of the image bearing member may not be uniformly charged. Consequently, the new resulting image formed in the next image forming process is deteriorated. For example, it may be streaked from the non-uniform charging.

SUMMARY OF THE INVENTION

Accordingly, it is an object of the present invention to provide an image forming apparatus which is relatively reduced in size without impairment to images produced by the image forming apparatus.

It is an another object of the present invention to provide an image forming apparatus wherein any effects of a developing agent remaining on an image bearing member during the next image forming process are prevented by a simple construction to improve the image quality formed on a medium.

It is a further object of the present invention to provide an image forming apparatus which can sufficiently disorder the residual toner image and uniformly charge the surface of the image bearing member by a simple construction.

Accordingly, the foregoing objectives, as well as others, are achieved by the present invention, which provides an image forming apparatus comprising means for forming a latent image on an image bearing member, developing and cleaning means for developing the formed latent image with a developing agent and for simultaneously removing the developing agent remaining on the image bearing member, means for transferring the developed image on the image bearing member to a recording medium and disordering and charging means for disordering the developing agent remaining on the image bearing member after transfer of the developed image by the image transfer means and for simultaneously charging the image bearing member, a latent image being formed on the image bearing member by the image forming means immediately thereafter. The disordering and charging means has a first disordering and charging member for disordering the residual developing agent and for charging the image bearing member and a second disordering and charging member for disordering the developing agent disordered by the first disordering and charging member and for uniformly distributing the charge on the image bearing member.

A further aspect of the present invention provides an image forming apparatus comprising means for forming a latent image on an image bearing member, developing and cleaning means, contained within a single unit, for developing the formed latent image with a developing agent and for simultaneously removing the developing agent remaining on the image bearing member, means for transferring the developed image on the image bearing member to a recording medium and disordering and charging means, contained within a single unit, for disordering the developing agent remaining on the image bearing member after transfer of the developed image by the transfer means and for simultaneously charging the image bearing member to permit a latent image to be formed on the image bearing member by the forming means. The disordering and charging means has a first conductive elastic member, in sliding contact with the surface of the image bearing member, for attracting and distributing the residual developing agent on the image bearing member and for charging the surface of the image bearing member at a first charge potential and a second conductive elastic member, in sliding contact with the surface of the image bearing member by the first conductive elastic member and for charging the surface of the image bearing member at a second charge potential. The forming means immediately thereafter forms the latent image on the image bearing member having been uniformly charged to the second charge potential and having eliminated any effects that may be caused by any residual developing agent.

In accordance with another aspect of the present invention, the above-stated objects are achieved by providing an image forming apparatus comprising means for forming a latent image on an image bearing member, a developing and cleaning roller, positioned for sliding contact with the image bearing member, for developing the formed latent image with a developing agent and for simultaneously removing the developing agent remaining on the image bearing member while the latent image is developed, means for transferring the developed image on the image bearing member to a recording medium, a first disordering and charging brush, positioned for sliding contact with the surface of the image bearing member, for disordering the developing agent remaining on the image bearing member after transfer of the developed image by the image transfer means and for simultaneously charging the image bearing member at a first charge potential while the developing agent remaining on the image bearing member is disordered and a second disordering and charging brush, positioned for sliding contact with the surface of the image bearing member, further disordering the developing agent disordered by the first disordering and charging brush, so as to sufficiently render the developing image non-patterened, and for simultaneously charging the image bearing member at a second potential to permit forming the latent image on the image bearing member by the forming means immediately thereafter while the developing agent on the image bearing member is disordered.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
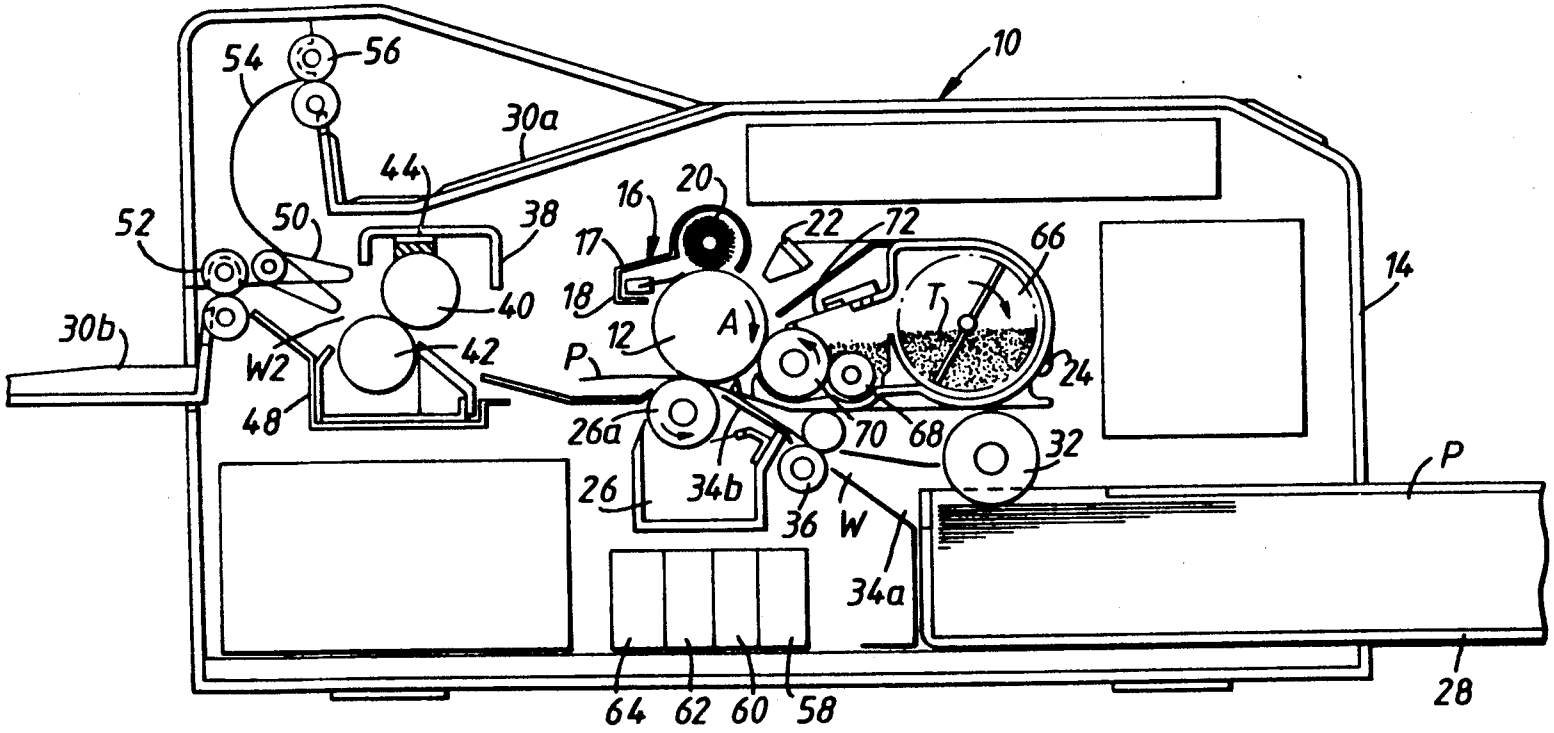
FIG. 1 is a sectional view of an image forming apparatus according to the present invention.

FIG. 1 shows an image forming apparatus according to the present invention. The image forming apparatus may be, of course, one of a wide variety known in the prior art. By way of example, however, the image forming apparatus depicted is an electrophotographic printer. Electrophotographic printer 10 may serve as an output device for a host computer (not shown). In response to a print command from the host computer, electrophotographic printer 10 performs an image forming operation to form an image on a medium such as a paper sheet according to data supplied from the host computer, a stack of paper sheets being shown as paper P.

Referring further to FIG. 1, the internal construction of electrophotographic printer 10 will be described.

Electrophotographic printer 10 includes an image bearing member 12, for example, a photosensitive drum, for forming a latent image in response to light on the surface thereof. Image bearing member 12 is disposed substantially in the center of a housing 14 and is formed, for example, of an organic photoconductor (OPC). Image bearing member 12 preferably has a drum diameter of about 40 mm and is rotated by an electric motor (not shown) in the direction of arrow A.

A disordering and charging device 16, a latent image forming device (an exposure unit) 22, a developing and cleaning device 24 and an image transfer device 26 respectively are arranged around the periphery of image bearing member 12 in the direction of its rotation.

Disordering and charging device 16 disorders the residual toner remaining on image bearing member 12 and simultaneously charges the entire surface of image bearing member 12 to a uniform level of charge in order to prepare the surface for forming a latent image. Disordering and charging device 16 in accordance with the principles of the present invention includes a unit 17 having a first conductive elastic member 18 and a second conductive elastic member 20.

Latent image forming device 22 radiates a light beam L on image bearing member 12, so that a latent image is formed on the surface of image bearing member 12.

Developing and cleaning device 24 develops the latent image with a developing agent in order to form a visible image and removes the residual developing agent from image bearing member 12.

Image transfer device 26 includes a transfer roller 26a which faces image bearing member 12 at an image transfer position. Image transfer device 26 transfers the developed image onto a medium such as a paper sheet P.

A paper supply cassette 28 is inserted into a lower portion of housing 14. Cassette 28 holds a supply of paper sheets P. A first output tray 30a is located on the upper portion of housing 14 to receive printed paper sheets P output from electrophotographic printer 10. A second output tray 30b is located on a side of housing 14, so that second output tray 30b may alternatively receive printed paper sheets P.

A pickup roller 32 for picking up paper sheets P from cassette 28 is provided at the top end of cassette 28 when cassette 28 is inserted into housing 14. Pickup roller 32 has a semicircular cross-section and a flat surface. Paper sheet P, when picked up from cassette 28, is then transported to the image transfer position through a feeding path W1. Feeding path W1 has feeding guides 34a and 34b and a pair of aligning rollers 36.

A fixing unit 38 is located down stream of the image transfer position. Fixing unit 38 fixes the toner image onto paper sheet P by heating and pressing paper sheet P with the toner image. Fixing unit 38 has a heating roller 40, a pressing roller 42 for pressing against heating roller 40 and a cleaner 44 for cleaning the surface of heating roller 40.

A guide 46 is located between the image transfer position and fixing unit 38. Paper sheet P from the image transfer position is transported to fixing unit 38 along guide 46. An eject path W2 is located down stream of fixing unit 38. Eject path W2 ejects paper sheet P with the fixed toner image onto output tray 30a or 30b. Eject path W2 comprises a first guide 48, a gate 50, first pair of eject rollers 52, a second guide 54 and second pair of eject rollers 56. Gate 50 selects the eject position of paper sheet P with the fixed toner image. Both positions of gate 50 are shown although, in practice only one path is predetermined by external controls to housing 14. Thereby, paper sheet P is transported to either output tray 30a or 30b, depending on the position of gate 50.

Also, a power source 58 is connected to developing and cleaning device 24 and a power source 60 is connected to image transfer device 26. A developing voltage bias is applied to developing and cleaning device 24 from power source 58. A bias voltage from power source 60 is applied to image transfer device 26. Also, power sources 62 and 64 are connected to disordering and charging device 16. First conductive elastic member 18 is connected to power source 62 and receives a voltage from power source 62. Second conductive elastic member 20 is connected to power source 64 and receives a voltage from power source 64.

The image forming operation of electrophotographic printer 10 will now be described.

Image bearing member 12 is rotated in the direction of arrow A and the peripheral surface of image bearing member 12 is charged to −500 to −800 V by disordering and charging device 16. Then, the charged area is exposed by the irradiation of light beam L in response to data received from the host computer by latent image forming device 22. As a result, a latent image is formed on the surface of image bearing member 12.

The formed latent image is transported to a developing and cleaning position facing developing and cleaning device 24. Developing and cleaning device 24 includes a hopper 66, a toner feeding roller 68 and a developing and cleaning roller 70. Hopper 66 stores non-magnetic one-component toner T as a developing agent. Toner feeding roller 68 transports toner T to developing and cleaning roller 70 and rakes toner T to prevent a cohesion of toner T to hopper 66. Developing and cleaning roller 70 supplies toner T to image bearing member 12. The latent image formed on image bearing member 12 is developed to a toner image stage by toner T supplied from developing and cleaning roller 70. In this embodiment, developing and cleaning roller 70 also operates as a cleaning roller to remove residual toner from image bearing member 12 and to restore the residual toner into hopper 66 after the formed latent image is developed.

Developing and cleaning roller 70 includes an elastic layer (not shown) and a conductive surface layer (not shown) surrounding the elastic layer, so that developing and cleaning roller 70 is wholly elastic. The elastic layer is made of an elastic material with an elasticity of about 30° to 70° (the JIS rubber-hardness measurement method), for example, foamed polyurethane, silicon rubber, urethane rubber or diene rubber. The conductive surface layer is formed of conductive material with a resistance of $10^2$ to $10^8$ Ω.cm. Also, the material of the conductive surface layer is formed by coating, for example, a mixture of urethane resin with 10 to 30 percent by weight of a conductive carbon.

Developing and cleaning roller 70 rotates in frictional contact with a friction blade 72 thus causing a frictional electric charge build-up. Friction blade 72 is formed of phosphor bronze, polyurethane resin or silicon resin. Thus, toner T supplied by developing and cleaning roller 70 is charged when toner T passes through between the surface of developing and cleaning roller 70 and frictional blade 72. A thin layer of toner T is thus attracted to the surface of developing and cleaning roller 70. For example, toner T is charged to about −5 to −30 μc/g by the friction of blade 72 and the conductive surface layer of developing and cleaning roller 70. Also, the conductive surface layer is electrically connected to power source 58. Thus, a specified developing bias voltage is applied to the conductive surface layer. In this case, a voltage of about −150 to −450 V is applied to developing and cleaning roller 70.

Developing and cleaning roller 70 makes contact with image bearing member 12 such that a nip width of 1 to 4 mm is formed by elastic deformation of the roller 70, and a toner image is formed by the adherence of toner T to the roller 70. In this case, toner T adheres to an area which has been irradiated by light beam L.

Also, developing and cleaning device 24 removes the residual toner from image bearing member 12 left after the operation of developing and cleaning roller 70.

The above developing and cleaning process will now be described in more detail.

After transfer of the developed image by image transfer device 26, the latent image and a small amount of toner particles which have not been transferred onto paper sheet P remain on the surface of image bearing member 12.

Further, any toner remaining on image bearing member 12 is transported to disordering and charging device 16 and are made non-patterned by disordering and charging device 16. The residual toner is finely disturbed to an unreadable state by disordering and charging device 16 which provides electrostatic and mechanical force.

Thus, the residual toner on the surface of image bearing member 12, which has passed through disordering and charging device 16 is thoroughly distributed in a fine fog-like state and no longer carries any information such as characters or an image.

Also, image bearing member 12 is charged uniformly by disordering and charging device 16. Image bearing member 12, once charged by disordering and charging device 16, is then exposed, and a latent image is formed on image bearing member 12 by latent image forming device 22. By the time a new latent image is formed, residual toner is thoroughly and thinly dispersed on the surface of image bearing member 12. Thus, no exposure randomness will occur and the residual potential of the surface of image bearing member 12 is uniform after exposure. Thereby, in the next developing process, a uniform toner image may be obtained, since the residual potential of the surface of image bearing member 12 is uniform after exposure.

The latent image formed on image bearing member 12 and residual toner then reaches the developing and cleaning position facing developing and cleaning device 24. As described above, developing and cleaning device 24 has developing and cleaning roller 70 including the elastic layer with the elasticity of 30° to 70° and the conductive surface layer with the conductivity of $10^2$ to $10^8\Omega$.cm. Thus, a mechanical load of 20 to 150 g/cm is applied to developing and cleaning roller 70 as a linear load, and developing and cleaning roller 70 makes pressure contact with a rotational speed difference between the drum speed and the brush roller speed of about 1.5 to 4 times. Thereby, developing roller 70 produces a nip width of about 1 to 4 mm in relation to the surface of image bearing member 12. The residual toner on image bearing member 12 and toner T supplied by developing roller 70 are agitated and rubbed in this nip width and a strong frictional force is generated. Also, developing and cleaning roller 70 has applied to it a predetermined developing voltage. The predetermined developing bias voltage takes an appropriate value between the residual potential of the exposed portion and the potential of the unexposed portion on developing and cleaning roller 70. In the unexposed portion, the attraction due to the developing bias voltage exceeds that of image bearing member 12. The residual toner adhering to the non-image portion (unexposed portion) is attracted to developing and cleaning roller 70. Thereby, residual toner particles are removed from image bearing member 12. Moreover, toner T supplied from developing and cleaning roller 70 adheres to the exposed portion of image bearing member 12 by applying a predetermined developing bias voltage on developing and cleaning roller 70.

In this case, there is a small quantity of residual toner remaining. The residual toner also is distributed beforehand in a fine fog by disordering and charging device 16. Therefore, developing and cleaning device 24 may efficiently remove residual toner on image bearing member 12.

Then, after the developing and cleaning process, the developed image formed on image bearing member 12 is transferred onto paper sheet P at the image transfer position.

After the developing and cleaning process, the toner image is transported to the image transfer position which faces transfer device 26. At the same time, paper sheet P from paper supply cassette 28 is fed through feeding path W1. Transfer device 26 has transfer roller **26*a* to which is applied an AC bias voltage biased towards plus from power source 60. This voltage is applied to the surface of transfer roller 26*a* which has a surface conductivity of $10^5$ to $10^9\Omega$.cm. Thus, the reverse side of paper sheet P has applied to it a bias voltage biased towards plus by transfer roller 26*a*. The toner image of the surface of image bearing member 12** is electrostatically attracted to paper sheet P by the bias voltage, and is transferred onto paper sheet P.

After the image transfer process, paper sheet P is conveyed to fixing unit 38 and the toner image is fixed on paper sheet P. Paper sheet P with the fixed toner image is selectively transported to output tray **30*a* or 30*b***.

The latent image and a residual toner image remain on image bearing member 12 after the image transfer process and these are transported to the area which faces disordering and charging device 16.

As described above, disordering and charging device 16 includes unit 17 having first and second conductive elastic members 18 and 20. First and second conductive elastic members 18 and 20 are supported in unit 17 such that first and second conductive elastic members 18 and 20 are in sliding contact with the surface of image bearing member 12.

Figure 2:
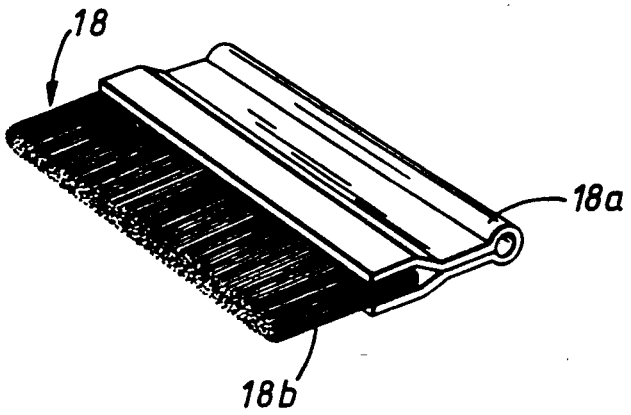
FIG. 2 is a perspective view of a first disordering and charging member shown in FIG. 1.

As shown in FIG. 2 first conductive elastic member 18 includes a plate-shaped support member **18*a* and a brush member 18*b* supported by support member 18*a*. Support member 18*a* is made of a conductive member, for example, aluminum, stainless steel or the like. Brush member 18*b* is made of conductive fibers which are attached on support member 18*a* at a density of about 400 to 500 pcs./cm. Each of the conductive fibers is formed of a conductive carbon and a fiber, for example, rayon or nylon and so on. The fiber has a length of about 2 to 20 mm, a thickness of about 2 to 15 denier and an electrical resistance of $10^3$ to $10^9\ \Omega$.cm. Brush member 18*b* is positioned to rub against the surface of image bearing member 12 and is in sliding contact with the surface of image bearing member 12 in the same direction as the rotation of image bearing member 12**.

Figure 3:
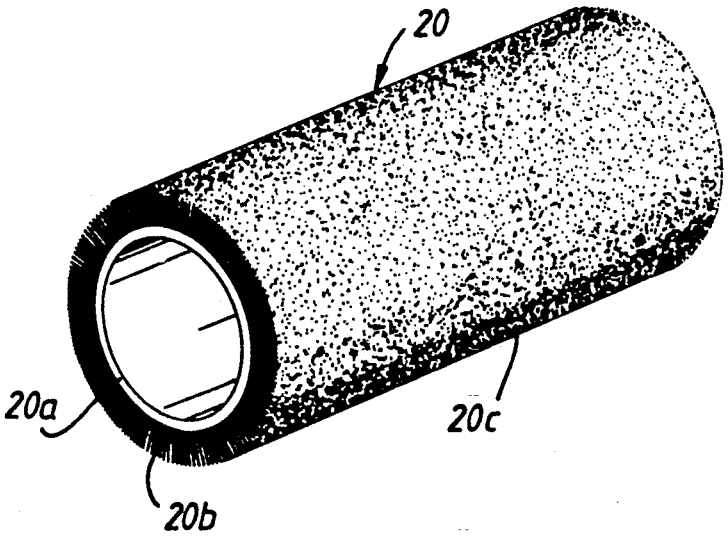
FIG. 3 is a perspective view of a second disordering and charging member shown in FIG. 1.

Also, referring to FIG. 3, second conductive elastic member 20 includes a rotary cylinder **20*a*, a conductive layer 20*b* and a conductive brush member 20*c* and has a diameter of about 20 to 30 mm. Rotary cylinder 20*a* is formed of paper, plastic or metal. Conductive layer 20*b* is formed by a conductive adhesive coated on rotary cylinder 20*a*. Conductive brush member 20*c* is made of conductive fibers which are planted on rotary cylinder 20*a* through conductive layer 20*b* at a density of about 1,000 to 20,000 pcs./$cm^2$. Each of the conductive fibers of brush member 20*c* is made of the same fiber as the conductive fiber of brush member 18*b*. Thereby, second conductive elastic member 20 rotates in contact with the surface of image bearing member 12. For example, second conductive elastic member 20 rotates at a peripheral speed about 1.5 to 5 times faster than the peripheral speed of image bearing member 12 when second member 20 rotates in the same direction as the rotation of image bearing member 12. Also, second conductive elastic member 20 rotates at a peripheral speed about 1 to 4 times faster than the peripheral speed of image bearing member 12 when second member 20 rotates in the opposite direction as the rotation of image bearing member 12**.

First conductive elastic member 18 is supplied with a voltage from power source 62. In this case, the voltage is a DC voltage of about 0 to −500 V and an AC bias voltage of about 800 to 2,000 V (peak-to-peak) and changing in frequency from about 0.1 to 5 KHz. Also, second conductive elastic member 20 is supplied with a voltage from power source 64. In this embodiment, the bias voltage is a DC voltage of about −400 to −1000 V and an AC bias voltage of about 800 to 2,000 V (peak-to-peak) and changing in frequency from about 0.1 to 5 KHz. This DC bias voltage is approximately equal to the surface potential of image bearing member 12.

In the present embodiment, thereby, disordering and charging device 16 performs a first disordering and charging process by first conductive elastic member 18 and a second disordering and charging process by second conductive elastic member 20. Also, in disordering and charging device 16, by adjusting the voltage applied to first and second conductive elastic members 18 and 20, it is possible to adjust the surface potential of image bearing member 12 and control disordering operations performed by first and second conductive elastic members 18 and 20.

First conductive elastic member 18 disorders the residual toner remaining on image bearing member 12 and simultaneously charges the surface of image bearing member to about 0 to −500 V. First conductive elastic member 18 also discharges the latent image remaining on image bearing member 12. Further, second conductive elastic member 20 disorders the residual toner more finely and distributes charge on the surface of image bearing member 12 to about −500 to −800 V. In the disordering process, first conductive member 18 attracts and distributes the residual toner remaining on image bearing member 12. Also, second conductive member 20 attracts and distributes the residual toner distributed on image bearing member 12 by first conductive member 18 so as to sufficiently disorder any pattern therein. Thereby, disordering and charging device 16 can uniformly charge the entire surface of image bearing member 12 to about −500 to −800 V and sufficiently disorder the residual toner remaining on image bearing member 12. Thus, in disordering and charging device 16 having first and second conductive elastic members 18 and 20, the surface potential of image bearing member 12 becomes uniform and the residual toner can be sufficiently disordered. Therefore, a resultant image formed in the next cycle is of high quality.

Further, in this embodiment of the present invention, electrophotographic printer 10 having disordering and charging device 16 is relatively reduced in size without damaging a resultant image. Also, any adverse effects of a developing agent remaining on image bearing member 12 during the next image forming process are prevented by a simple construction to improve the image quality.

Next, charge characteristics of disordering and charging device 16 will be described.

Figure 4:
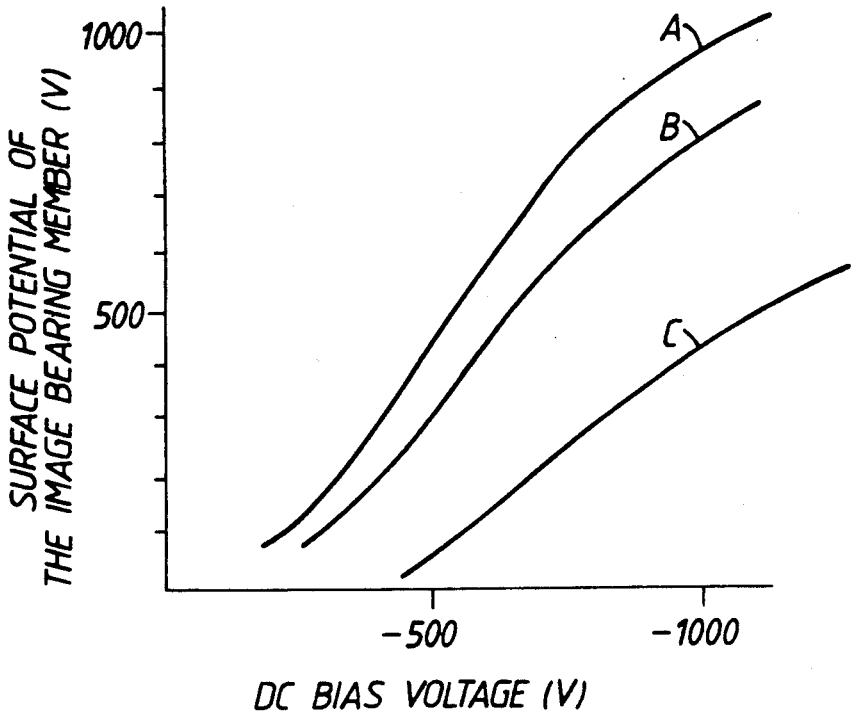
FIG. 4 is a graph showing charge characteristics of the disordering and charging device shown in FIG. 1.

FIG. 4 shows an example of the charge characteristics measured on a sample of second conductive elastic member 20 of disordering and charging device 16. The Y-coordinate shows the surface potential of image bearing member 12, while the X-coordinate shows the DC voltage supplied from power source 64, which is applied to second conductive elastic member 20 together with the AC bias voltage. Graph A is a charge characteristic when an AC bias voltage with a frequency of 2 KHz and a peak-to-peak AC voltage of 1,500 V is applied. Graph B is a charge characteristic when an AC bias voltage with a frequency of 2 KHz and a peak-to-peak AC bias voltage of 1,000 V is applied. Graph C is a reference graph showing a charge characteristic when AC bias voltage is not applied.

As is easily seen from the graphs A, B and C, disordering and charging device 16 may effectively charge when the AC bias voltage was used together with a DC bias voltage. The result of this example, when the AC bias voltage was used, for example, in the condition shown in graph A, the surface of image bearing member 12 is charged to about −500 V by disordering and charging device 16 which is supplied with a DC voltage of about −500 to 550 V.

Also, under the bias condition of only the DC voltage (the condition shown in graph C), charging randomness was caused. On the contrary, under the bias voltage conditions of the AC bias voltage of the peak-to-peak voltage over 1,000 V (the conditions shown in graphs A and B), charging randomness was almost not caused.

Moreover, in the resultant toner image formed under the voltage condition of only the DC voltage, some brushing traces caused by conductive brush members 18 and 20 of disordering and charging device 16 were recognized. On the other hand, in the case of the resultant image formed under the voltage conditions of the AC bias voltage of the peak-to-peak voltage over 1,000 V, no brushing trace was recognized.

Figure 5:
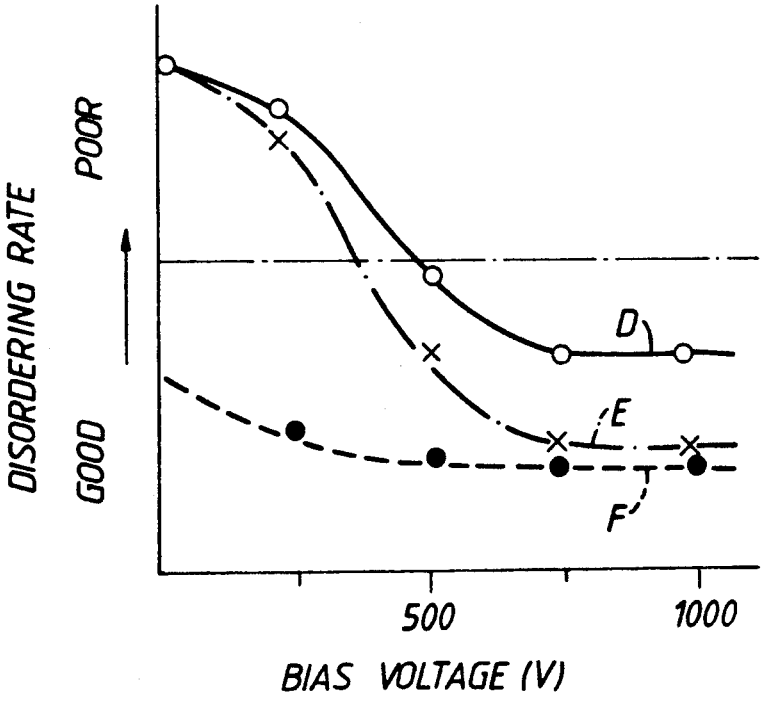
FIG. 5 is a graph showing the relationship between the amount of residual toner image and the bias voltage applied to the disordering and charging device shown in FIG. 1.

FIG. 5 shows a result of another test which was carried out for examining the influence of the voltage applied to first conductive elastic member 18 against the residual toner. In this test, second conductive elastic member 20 was applied a DC voltage of −800 V and an AC bias voltage with a frequency of 2 KHz and a peak-to-peak AC voltage of 1,500 V. Also, developing and cleaning roller 70 was applied a DC voltage of −200 V. The Y-coordinate shows the frequency of samples having good resultant image which were checked. The results of the test are shown by a manner of relative comparison, so that the Y-coordinate simply indicates the frequency without dimension. Thus, the downward direction of Y-coordinate indicates a larger frequency of a good resultant image, while the upward direction indicates a smaller frequency of a good resultant image. Here, the term for a good resultant image means that a disordering rate is high, such that residual toner is not substantially recognized on the resultant image. Also, graph D is the disordering rate when a plus DC bias (X-coordinate) is applied. Graph E is the disordering rate when an AC bias voltage (X-coordinate) with a frequency of 1 KHz (effective value) is applied. Graph F is the disordering rate when a DC voltage (X-coordinate) is changed with respect to an AC bias voltage with a frequency of 1 KHz and an AC voltage of 500 to 700 V (effective value).

Referring now to FIG. 5, in the condition shown in graph D, the voltage over about 500 V is effective to increase the disordering rate. Also, in the condition shown in graph E, the voltage over about 350 V of AC bias voltage (effective value) is effective to sufficiently increase the disordering rate. Further, in the condition shown in graph F, the residual toner image was substantially disordered. Thereby, it was apparent that electrophotographic printer 10 having disordering and charging device 16 can form a good resultant image under the various conditions shown in graphs D, E and F.

Also, in the present embodiment, the result of carrying out a 20,000 paper sheets life test was that excellent quality of images, equivalent to the initial images, could be obtained.

Figure 6:
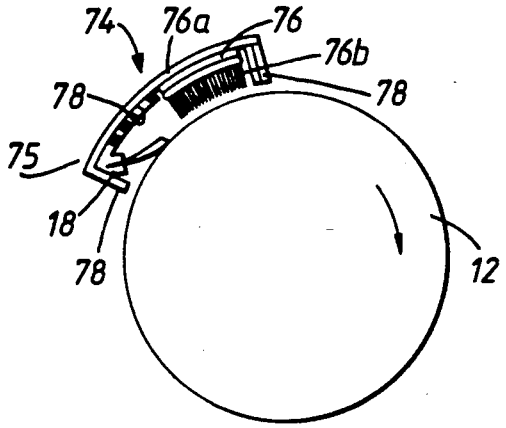
FIGS. 6 to 8 are sectional views of other embodiments of the disordering and charging device shown in FIG. 1.

In another embodiment of the present invention, shown in FIG. 6, a disordering and charging device 74 includes a unit 75 having first conductive elastic member 18 and a third conductive elastic member 76 different from the previously discussed second conductive member 20. Third conductive elastic member 76 has a support member 76a and a brush member 76b supported by support member 76a. Brush member 76b has a similar shape to a shoeshine brush. Support member 76a is made of a conductive material, for example, aluminum, stainless steel or the like. Brush member 76b is made of conductive fibers which are attached to support member 76a at a density of about 400 to 500 pcs./cm. Each of the conductive fibers is formed of a conductive carbon and a fiber, for example, rayon, nylon or the like. The fiber has a length of about 2 to 20 mm, a thickness of about 2 to 15 denier and an electrical resistance of $10^3$ to $10^9$ Ω.cm. Brush member 76b is positioned to rub against the surface of image bearing member 12 and is in sliding contact with the surface of image bearing member 12.

Figure 7:
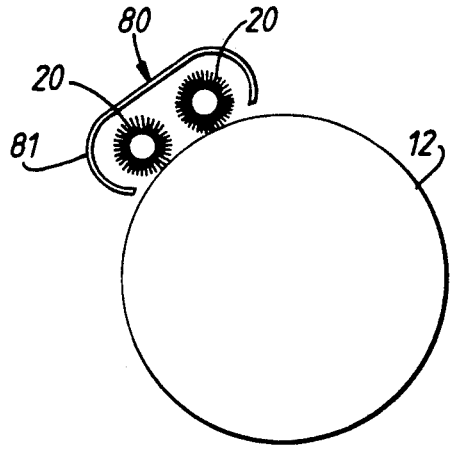
Figure 8:
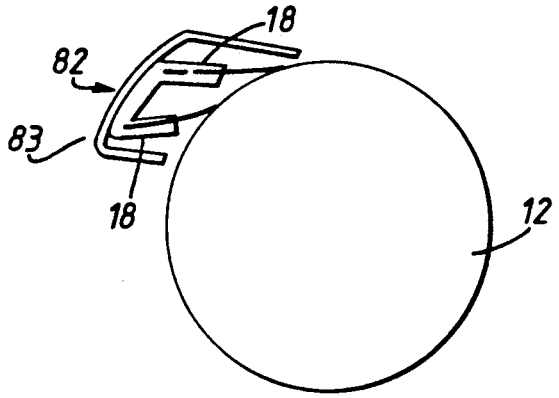

Further, in another embodiment, as shown in FIG. 7, a disordering and charging device 80 has a unit 81 including a pair of second conductive elastic members 20. Moreover, according to FIG. 8, another disordering and charging device 82 has a unit 83 including a pair of first conductive elastic members 18.

In disordering and charging devices 74, 80 and 82, the surface of image bearing member 12 may be uniformly charged and the residual toner image may be sufficiently disordered by applying the same voltages as is applied by the respective members of disordering and charging device 16.

Also, as shown in FIG. 6, disordering and charging device 74 includes an ozone decomposing/absorbing member 78 supported in unit 75. Ozone decomposing/absorbing member 78 is made of a plate member which is formed of active carbon or active carbon added platinum catalyst. Ozone decomposing/absorbing member 78 can remove the slight amount of ozone generated in disordering and charging device 74. In this manner, disordering and charging device 74 can prevent the oxidation of image bearing member 12.

It should be understood that the detailed description and examples, which indicate presently preferred embodiments of this invention, are given by way of illustration only. Various modifications and changes may be made to the present invention, without departing from the scope or spirit of the invention, as set forth in the following claims.

I claim:

1. An image forming apparatus comprising:

means for forming a latent image on an image bearing member;

developing and cleaning means for developing the formed latent image with a developing agent and for simultaneously removing the developing agent remaining on the image bearing member;

image transfer means for transferring the developed image on the image bearing member to a recording medium; and disordering and charging means for disordering the developing agent remaining on the image bearing member after transfer of the developed image by the image transfer means and for simultaneously charging the image bearing member to permit forming the latent image on the image bearing member by the forming means, the disordering and charging means having a first disordering and charging member for disordering the residual developing agent and for charging the image bearing member and a second disordering and charging member for disordering the developing agent disordered by the first disordering and charging member and for uniformly charging the image bearing member.

2. The apparatus of claim 1, wherein the first and second disordering and charging member respectively have a conductive elastic member, in sliding contact with the surface of the image bearing member, for attracting and distributing developing agent remaining on the image bearing member.

3. The apparatus of claim 2, further comprising first applying means for applying a voltage to the first disordering and charging member and second applying means for applying a voltage to the second disordering and charging member.

4. The apparatus of claim 2, wherein the conductive elastic member has a plurality of brush members which are positioned to rub against the image bearing member.

5. The apparatus of claim 1, wherein the latent image forming means has exposing means for exposing the image bearing member to form the latent image on the image bearing member; and wherein the disordering and charging means is positioned between the image transfer means and the exposing means.

6. The apparatus of claim 1, wherein the developing and cleaning means has a developing and cleaning roller, positioned for sliding contact with the image bearing member, for supplying the developing agent to the image bearing member and for simultaneously removing developing agent remaining on the image bearing member.

7. An image forming apparatus comprising:

means for forming a latent image on an image bearing member;

developing and cleaning means, contained within a single unit, for developing the formed latent image with a developing agent and for simultaneously removing developing agent remaining on the image bearing member;

means for transferring the developed image on the image bearing member to a recording medium; and disordering and charging means, contained within a single unit, for disordering the developing agent remaining on the image bearing member after transfer of the developed image by the transfer means and for simultaneously charging the image bearing member to permit forming the latent image on the image bearing member by the forming means, the disordering and charging means having a first conductive elastic member, in sliding contact with the surface of the image bearing member, for attracting and distributing the residual developing agent on the image bearing member and for charging the surface of the image bearing member at a first charge potential and a second conductive elastic member, in sliding contact with the surface of the image bearing member, for attracting and distributing the developing agent distributed on the image bearing member by the first conductive elastic member and for charging the surface of the image bearing member at a second charge potential, wherein the forming means forms the latent image on the image bearing member which is uniformly charged to a second charge potential, any residual developing agent being sufficiently disordered.

8. The apparatus of claim 7, further comprising first applying means for applying a voltage to the first conductive elastic member and second applying means for applying a voltage to the second conductive elastic member.

9. The apparatus of claim 7, wherein the latent image forming means comprises exposing means for exposing the image bearing member to form the latent image on the image bearing member; and wherein the disordering and charging means is positioned between the transferring means and the exposing means.

10. The apparatus of claim 7, wherein the developing and cleaning means has a developing and cleaning roller, positioned for sliding contact with the image bearing member, for supplying the developing agent to the image bearing member and for simultaneously removing the developing agent remaining on the image bearing member.

11. An image forming apparatus comprising:

means for forming a latent image on an image bearing member;

a developing and cleaning roller, positioned for sliding contact with the image bearing member, for developing the formed latent image with a developing agent and for simultaneously removing the developing agent remaining on the image bearing member while the latent image is developed;

means for transfering the developed image on the image bearing member to a recording medium;

a first disordering and charging brush, positioned for sliding contact with the surface of the image bearing member, for disordering developing agent remaining on the image bearing member after transfer of the developed image by the transfer means and for simultaneously charging the image bearing member to a first charge potential, while the developing agent remaining on the image bearing member being disordered thereby; and a second disordering and charging brush, positioned for sliding contact with the surface of the image bearing member, for disordering the developing agent disordered by the first disordering and charging brush, so as to sufficiently render the developing image nonpatterned, and for simultaneously charging the image bearing member at a second potential permitting the formation of a latent image on the image bearing member by the forming means while the developing agent on the image bearing member is disordered.

12. The apparatus of claim 11, further comprising first applying means for applying a voltage to the first disordering and charging brush and second applying means for applying a voltage to the second disordering and charging brush.

13. An image forming apparatus for forming a developed image on an image bearing member by a developing agent, having an image transfer device for transferring the developed image formed on the image bearing member to a recording medium, characterized by;

a first disordering and charging member for disordering the developing agent remaining on the image bearing member after transfer of the developed image by the image transfer device and for simultaneously charging the image bearing member at a first charge potential; and a second disordering and charging member for disordering the developing agent disordered by the first disordering and charging member and for simultaneously charging the image bearing member at a second charge potential different from the first charge potential, wherein the image bearing member is charged to the second charge potential and any residual developing agent is further disordered.

14. An image forming method comprising the steps of:

disordering a residual developing agent remaining on an image bearing member after transfer of a developed image by a transfer device and for simultaneously charging the image bearing member at a first charge potential; and further disordering the disordered developing agent on the image bearing member and for simultaneously charging the charged image bearing member at a second charge potential different from the first charge potential.

* * * * *